United States Patent [19]

Ohnishi et al.

[11] 4,366,491

[45] Dec. 28, 1982

[54] ELECTROGRAPHIC IMAGING SYSTEM

[76] Inventors: Masaru Ohnishi; Syuji Iwata, both c/o Mitsubishi Denki Kabushiki Kaisha Ohyokiki Kenkyusho, No. 80, Aza-Nakano, Minamishimizu, Amagasaki-shi, Hyogo-ken, Japan

[21] Appl. No.: 81,488

[22] Filed: Oct. 3, 1979

[30] Foreign Application Priority Data

Nov. 21, 1978 [JP] Japan ..... 53-144495
Dec. 29, 1978 [JP] Japan ..... 53-161620

[51] Int. Cl.[3] ..... G03G 15/44

[52] U.S. Cl. ..... 346/155; 101/DIG. 13; 346/153.1

[58] Field of Search ..... 346/155, 74.1, 154, 346/153; 101/DIG. 13

[56] References Cited

U.S. PATENT DOCUMENTS 3,611,419 10/1971 Blumenthal ..... 346/155
4,192,232 3/1980 Kato et al. ..... 101/DIG. 13
4,215,355 7/1980 Moore ..... 346/155
4,262,294 4/1981 Hara et al. ..... 346/155
4,271,417 6/1981 Blumenthal et al. ..... 346/154

FOREIGN PATENT DOCUMENTS 470829 8/1975 U.S.S.R. ..... 346/153

*Primary Examiner*—Glen R. Swann, III

[57] ABSTRACT

An electrographic imaging system for driving a single surface control electrostatic recording head has recording stylus electrodes arranged in groups with respective stylus electrodes of each group connected in parallel and control electrodes arranged adjacent respective groups of stylus electrodes so as to form electrostatic latent images on a dielectric layer of a record medium contacting the recording head. In the electrographic imaging system a first control pulse voltage is applied to selected control electrode adjacent a selected group of stylus electrodes; and then a second control pulse voltage having a different polarity is applied to the control electrode and simultaneously, a recording pulse voltage having the same polarity as the polarity of the first control pulse voltage is applied to the selected respective group of recording stylus electrodes.

6 Claims, 17 Drawing Figures

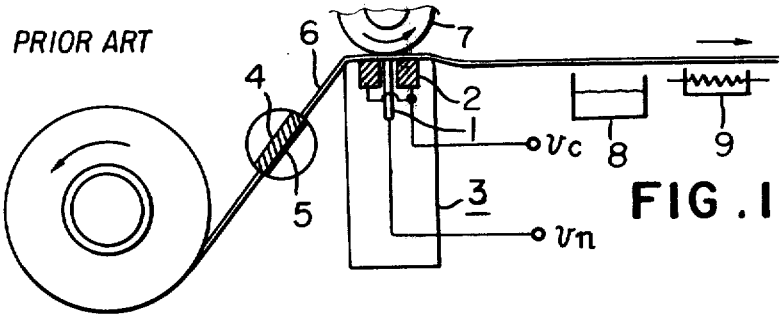
FIG. 1
FIG. 2
PRIOR ART
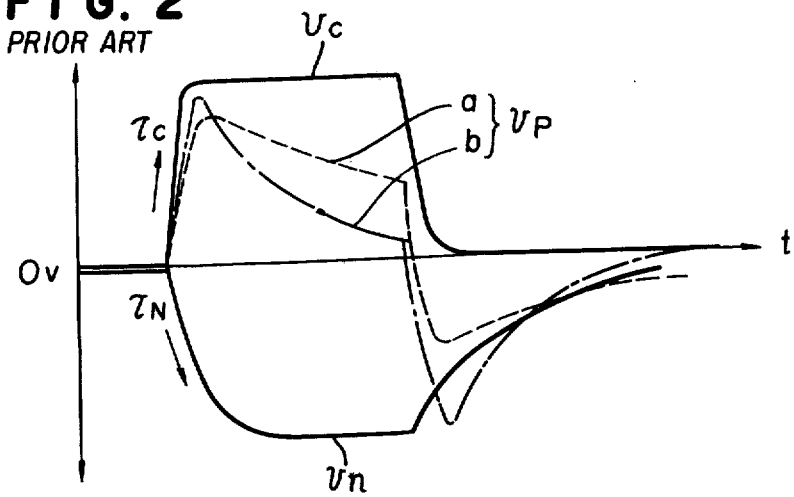
FIG. 3
PRIOR ART
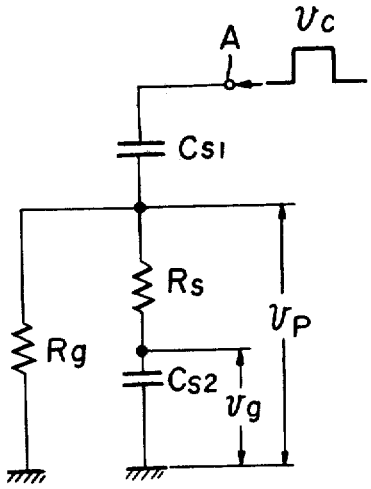

ELECTROGRAPHIC IMAGING SYSTEM

BACKGROUND OF THE INVENTION

1. Field of the Invention

The present invention relates to an electrographic imaging system using an electrostatic recording head.

2. Description of the Prior Arts

FIG. 1 is a schematic view for showing a fundamental structure of a printing part in an electrographic imaging apparatus using a known single surface control electrostatic recording head (hereinafter referring to as a recording head). In FIG. 1, the reference numeral (1) designates recording stylus (only one stylus is shown) and many recording needles are orthogonally arranged to a paper. A plurality of groups of control electrodes (2) (only one group is shown) are arranged for each predetermined number of the recording styluses (1) at both sides of the recording styluses. An electrostatic record medium (6) made of a conductive substrate (4) and a dielectric layer (5) is press-contacted with a head surface of a recording head (3) having said structure.

Under such condition, a negative recording stylus voltage $v_n$ is uaually applied to the recording stylus (1) and a positive control voltage $v_c$ is simultaneously applied to the control electrode (2) whereby an electrostatic latent image is formed on the surface of the dielectric layer of the electrostatic record medium (6). The latent image formed on the electrostatic record medium (6) is developed in a toner development by a developing device (8) and the toner is melt-bonded by a heat-fixing device (9).

FIG. 2 shows waveforms $v_n$ and $v_c$ in the conventional electrographic imaging system; and $v_p$ is a potential of the conductive medium (4) just below the control electrode (2) to which the control voltage $v_c$ is applied.

FIG. 3 is an approximate equivalent circuit for the electrostatic record medium to which the control voltage $v_c$ is applied; and $C_{s1}$ designates and electrostatic capacity of the dielectric layer (5) just below the control electrode (2) to which the control voltage $v_c$ is applied; $C_{s2}$ designates an electrostatic capacity of the dielectric layer (5) at the part contacted with the control electrode being adjacent to the control electrode to which the control voltage $v_c$ is applied; $R_g$ designates a resistance of the conductive medium (4) from the earth point to the control electrode to which the control voltage $v_c$ is applied; $R_s$ designates a resistance of the conductive medium (4) between said two control electrodes.

The potential $v_p$ has the waveform shown by the curve a in FIG. 2. That is, a differential waveform of $v_c$ having a time constant of $$C_{s1} + \frac{R_g R_s}{(R_g + R_s)}$$

is substantially equal to the waveform of $v_p$.

The resistances $R_g$ and $R_s$ are remarkably decreased depending upon the elevation of the temperature or humidity. Accordingly, $v_p$ is in peak value at the leading edge of the control voltage $v_c$ and remarkably attenuates as shown by the curve b in FIG. 2 at high temperature and high humidity. The latent image is formed on the dielectric layer (5) by a voltage of the sum of absolute values of $v_p$ and the recording stylus voltage $v_n$.

In the case of a many stylus electrode type recording, recording multi-styluses are grouped and arranged in parallel. Accordingly, an electrostatic capacity between the recording styluses is ranging from about 150 to 400 pF. Thus, the time constant $\tau_n$ at the leading edge of the recording stylus voltage $v_n$ is longer than the time constant $\tau_c$ at the leading edge of the control voltage $v_c$. In the condition of high temperature and high humidity for characteristics shown in the curve b in FIG. 2, the potential $v_p$ attenuates to be small before reaching $v_n$ to the saturated value whereby the record density is remarkably decreased to cause defect of the recording to be disadvantageous.

The decrease of the record density at high temperature and in high humidity is the first disadvantage which can not be avoided in the conventional system.

Moreover, in the conventional system, a ghost image caused by a leakage of voltage to the adjacent control electrode is found as the second disadvantage.

FIG. 4 is a fundamental circuit diagram used in the conventional system. The reference numeral (101) designates recording multi-styluses electrodes which are linearly arranged; (201) designates control electrodes which are divided into units having predetermined electrodes and are arranged as groups at both sides of the recording styluses(101). In the embodiment, the control electrodes are divided into each unit for each five recording styluses (101).

The recording styluses(101) are connected to form alternately groups A and groups B for each five recording styluses so as to form a total 2n blocks.

In said structure, when the recording of the $A_1$ block is carried out, the recording stylus voltage $v_n$ is applied from the group A recording signal source **(10*a*) depending upon the predetermined recording pattern for $A_1$ and simultaneously, the control voltage $v_c$ is applied from the control voltage source (11) to $S_1$ and $S_2$ of the control electrodes (201)**. The recording is carried out only in the block $A_1$ to which both of $v_n$ and $v_c$ are simultaneously applied.

When $A_k$ is recorded, the control voltage $v_c$ is applied to $S_{2k-1}$ and $S_{2k}$. When $B_k$ is recorded, the control voltage $v_c$ is applied to $S_{2k}$ and $S_{2k+1}$. The recording for one line is sequentially completed.

When the state applying the pulse voltage $v_c$ to $S_{2k-1}$ and $S_{2k}$ is considered, the potential $v_g$ of the electrostatic record medium just below the adjacent control electrodes $S_{2k-2}$ and $S_{2k+1}$, is elevated to cause ghost voltage $v_g$ because of the leakage of $v_c$ as shown by the curves a and b in FIG. 5.

The curves a and b respectively correspond to $v_g$ in the conditions of low humidity and high humidity. Thus, the reason why $v_g$ is suddenly elevated in high humidity, is to decrease the resistance $r_s$ of the conductive medium of the electrostatic record medium in the equivalent circuit shown in FIG. 3. The time constant for charging to the capacity $C_{s2}$ from the adjacent control electrode is shortened so as to elevate $v_g$. Thus, the recording should be performed only in the block $A_k$, nevertheless, the recording is also performed in the block $A_{k+1}$ and $A_{k-1}$. The excess recorded images are referred to as the ghost. The formation of the ghost is the second disadvantage in the conventional system.

SUMMARY OF THE INVENTION

It is an object of the present invention to provide an electrographic imaging system in which said first and second disadvantages in the conventional system are overcome.

The present invention is to provide an electrographic imaging system wherein a control voltage $v_c$ is made of a combination of a pair of positive and negative pulses and the control voltage $v_c$ is applied for each one cycle in the predetermined polarity and the different polarity and the recording stylus voltage $v_n$ having the different polarity is applied during at least the period applying the control voltage having the different polarity.

In the modification of the embodiment of the present invention, the control voltage $v_c$ is applied for each one cycle in the predetermined polarity and the different polarity and the recording stylus voltage having the different polarity is applied during the period from the releasing of the control voltage having the predetermined polarity to the releasing of the control voltage having the different polarity.

BRIEF DESCRIPTION OF THE DRAWINGS

FIG. 1 is a schematic view of a fundamental structure of a printing part of an electrographic imaging apparatus using a single surface control electrostatic recording head;

FIG. 2 is a diagram of waveforms showing the relation of recording stylus voltages $v_n$ and control voltages $v_c$ in the conventional electrographic imaging system;

FIG. 3 is an approximate equivalent circuit of the control electrode part;

DETAILED DESCRIPTION OF THE PREFERRED EMBODIMENTS

Figure 4:
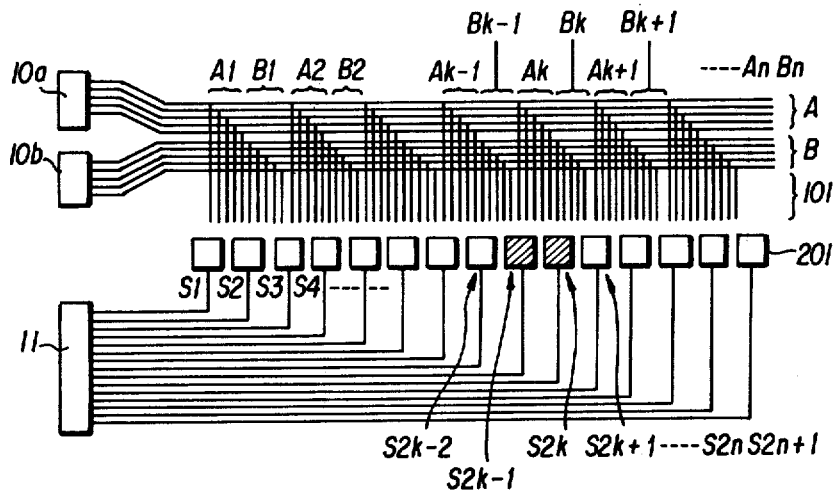
FIG. 4 is a circuit diagram for the fundamental structure used in the conventional system.
Figure 5:
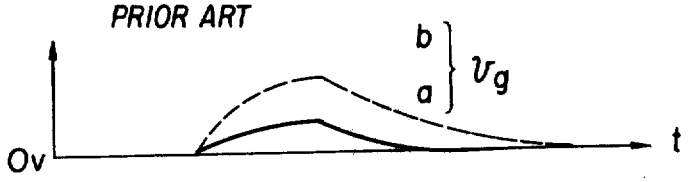
FIG. 5 PRIOR ART
FIG. 5 is a diagram of waveforms of ghost voltages found in the conventional system.
Figure 6:
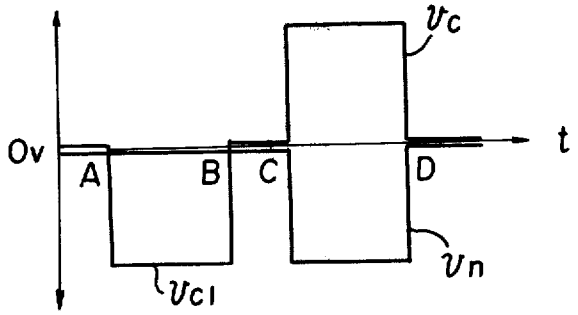
FIG. 6 is a diagram of waveforms showing the relation of $v_n$ and $v_c$ in one embodiment of the present invention.

FIG. 6 shows the typical relation of the control voltage $v_c$ and the recording stylus voltage $v_n$. The characteristic of the system is to combine a pair of positive and negative pulses for the control voltage $v_c$.

The first control voltage $v_{c1}$ which has the same polarity with that of $v_n$ is applied and then the second control pulse voltage $v_{c2}$ (positive in this case) which has the different polarity to that of $v_n$ is applied and $v_n$ is applied during the period overlapping the second pulse (simultaneous application in this case). The two disadvantages in the conventional system can be overcome by said feature.

Figure 7:
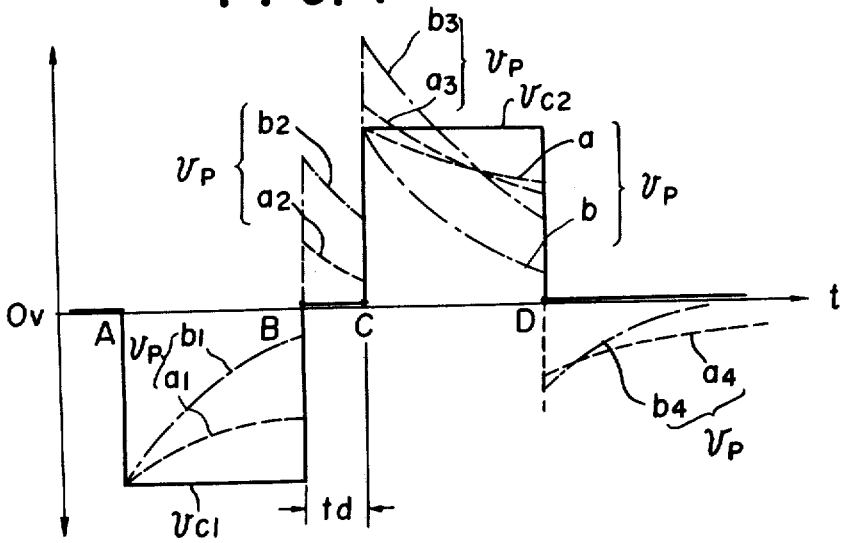
FIG. 7 is a diagram for illustrating variation of the potential $v_p$ of an electrostatic record medium in the embodiment of FIG. 6.

FIG. 7 shows the variation of the potential $v_p$ of the conductive medium of the electrostatic record medium in order to illustrate the effect for preventing the decrease of the record density in the condition of high humidity. The curves a and b respectively show time variations of $v_p$ in low humidity and high humidity.

When the first control pulse voltage $v_{c1}$ having negative polarity is applied at A and it is turned off at B, the potential $v_p$ is slowly attenuated in low humidity and it is remarkably attenuated in high humidity as shown by the curves $a_1$ and $b_1$ between A and B.

As it is clearly understood by the equivalent circuit shown in FIG. 3, when the $v_{c1}$ is turned off and the control voltage feeding terminal A is earthed, $v_p$ turnovers to the positive polarity side for the voltage charging the capacity $C_{s1}$ of the dielectric layer of the electrostatic record medium just below the control electrode to which $v_{c1}$ is applied. The condition is shown by the curve between B and C in FIG. 7. The values of the turnover voltages $a_2$, $b_2$ are higher at the side of higher attenuation of $v_p$ in high humidity. The present invention is to consider the feature that the turnover voltage in high humidity is greater, so as to prevent the decrease of the record density. The second control voltage pulse $v_{c2}$ having the different polarity to that of $v_{c1}$ is applied just after the turn-off of $v_{c1}$ or the time C delaying for $t_d$ from the turn-off of $v_{c1}$, and it is turned off at the time D. Because of the application of $v_{c2}$, the voltage by $v_{c2}$ is overlapped to the turnover voltage by $v_{c1}$, the potential $v_p$ is higher than that of the application of only $v_{c2}$. The peak value of $v_p$ is naturally increased in the higher humidity side as shown by the curves $a_3$ and $b_3$ between C and D.

The curves a and b in FIG. 7 respectively show waveforms of $v_p$ in low humidity and in high humidity when $v_{c1}$ is not applied in the case of FIG. 2. As shown in the curve b, the attenuation of $v_p$ is remarkably large in high humidity. In accordance with the system of the present invention, $b_3$ is higher than $a_3$ by the turnover voltage whereby the decrease of the record density can be prevented. Moreover, the record density is advantageously higher than those of the application of only $v_{c2}$ in all environments because of the turnover voltage.

The voltage $v_{c1}$ applied in the system of the present invention has the same polarity with that of the recording stylus voltage $v_n$ whereby the recording is not caused and no trouble is caused by the application of $v_{c1}$.

Figure 8:
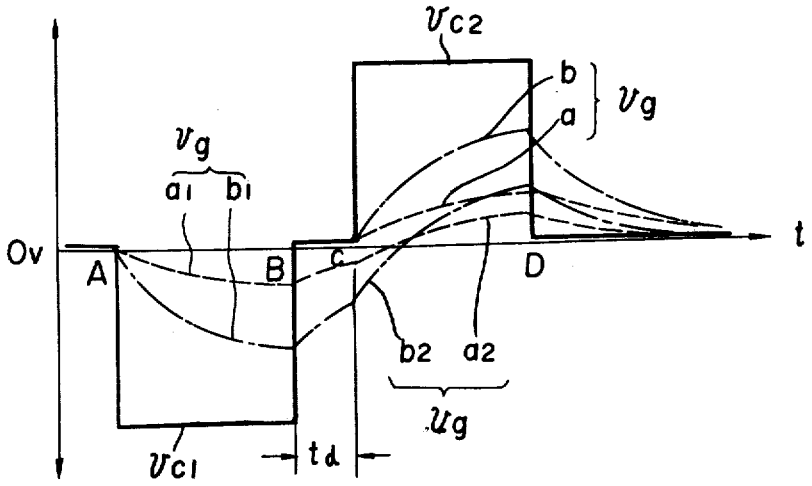
FIG. 8 is a diagram of waveforms of ghost voltage $v_g$ in the embodiment shown in FIG. 6.

FIG. 8 shows variation of the potential $v_g$ of the conductive medium of the electrostatic record medium just below the adjacent control electrodes in order to illustrate the effect for eliminating ghost in the system of the present invention.

When the negative pulse voltage $v_{c1}$ is applied, the potential $v_g$ is elevated in the negative polarity side as shown in the curves $a_1$ and $b_1$ in the condition of low humidity and high humidity. Then, the pulse voltage $v_{c2}$ is applied at C, the turnover of the potential $v_g$ is started. Thus, the induction pulse voltages $v_{c1}$ and $v_{c2}$ are in the counter directions each other. The values $a_2$ and $b_2$ of the potential $v_g$ having the same polarity with that of $v_{c2}$ can be remarkably decreased.

The waveforms of $v_g$ in the conventional system are given by the curves a and b in low humidity and in high humidity. The effect is clearly understood by the comparison of the curves $a_2$ and $b_2$.

In the system of the present invention, the delay time $t_d$ for $v_{c1}$ and $v_{c2}$ is preferably shorter. Thus, the effect for decreasing ghost is found even though the delay time $t_d$ is about several times of the pulse width of $v_{c1}$ or $v_{c2}$.

Figure 9:
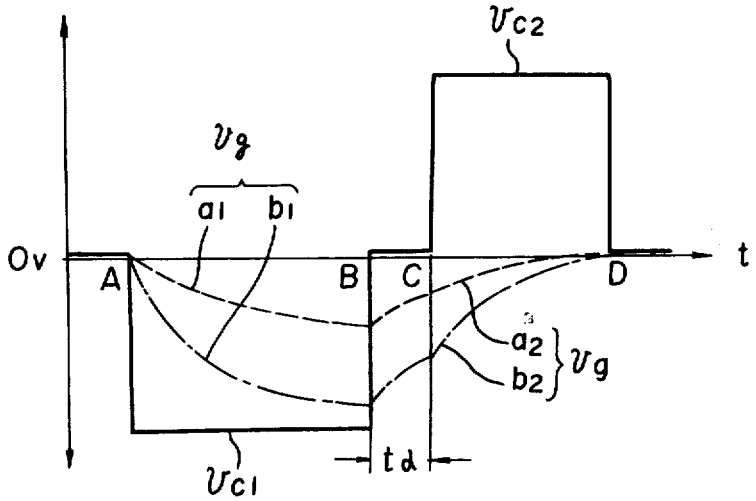
FIG. 9 is a diagram of waveforms of $v_{c1}$, $v_{c2}$ and $v_g$ in the other embodiment of the present invention.

FIG. 9 is a diagram illustrating the embodiment for completely eliminating $v_g$ even though the delay time $t_d$ is given.

When the pulse width of $v_{c1}$ is longer than that of $v_{c2}$, the potential $v_g$ after the $v_{c2}$ pulse application can be decreased to about zero. The similar effect can be given by increasing a peak value of the pulse of $v_{c1}$ over that of $v_{c2}$. On the other hand, the disadvantage of the conventional system can be overcome by decreasing the voltage of the pulse of $v_{c1}$ or the pulse width of $v_{c1}$ below that of $v_{c2}$.

Thus, in the system of the present invention, the waveform or the timing for application of the control voltage is not critical as far as $v_{c1}$ and $v_{c2}$ are respectively pulses having different polarity.

Figure 10:
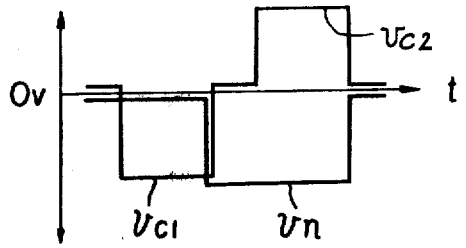
FIG. 10 is a diagram showing patterns of the control voltages and the recording stylus voltages in the other embodiment of the present invention.

FIG. 10 is a diagram of one embodiment of a pattern of the control voltage and the recording stylus voltage in the other embodiment.

Figure 11:
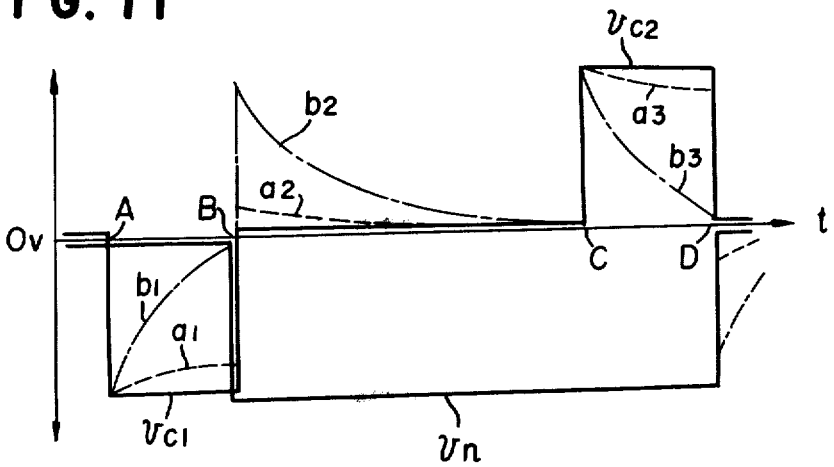
FIG. 11 is a diagram of waveforms for illustrating the variation of the potential $v_p$ of the conductive medium of the electrostatic record medium in the embodiment of FIG. 10.

FIG. 11 is a diagram of waveforms for illustrating variation of the potential $v_p$ in the voltage patterns shown in FIG. 10. The period from the time B releasing the control voltage $v_{c1}$ to the time C applying the control voltage $v_{c2}$ is shown by a longer scale.

In FIG. 11, the characteristic curve a shown by the dotted line shows the characteristic of variation of $v_p$ in low humidity and the characteristic curve b shown by the dotted chain line shows the characteristic of variation of $v_p$ in high humidity.

When the first control voltage pulse $v_{c1}$ having negative polarity is applied at the time A, $v_p$ slowly attenuates in low humidity as the characteristic curve $a_1$ whereas $v_p$ remarkably attenuates in high humidity as the characteristic curve $b_1$. As it is clearly understood from the equivalent circuit shown in FIG. 3, when the condition just after releasing the control voltage $v_{c1}$ and earthing the point A, is considered, the potential $v_p$ turnovers in the positive polarity side for the voltage charging the capacity $C_{s1}$ of the dielectric layer of the electrostatic record medium just below the control electrode to which $v_{c1}$ is applied. This condition is shown by the curves $a_2$ and $b_2$ between B and C in FIG. 11.

The turnover voltage is higher in high humidity for remarkable attenuation of $v_p$ than that of low humidity.

The present invention is to utilize said characteristics so as to prevent the decrease of the recording density in high humidity. That is, the recording stylus pulse voltage $v_n$ is applied during the period of B to C in which the turnover voltage shown in FIG. 11 is resulted, and the recording is performed by the second control pulse voltage $v_{c2}$ applied during the period C to D and the turnover voltage during the period B to C. The decrease of the record density is prevented by double recording in high humidity.

Figure 12:
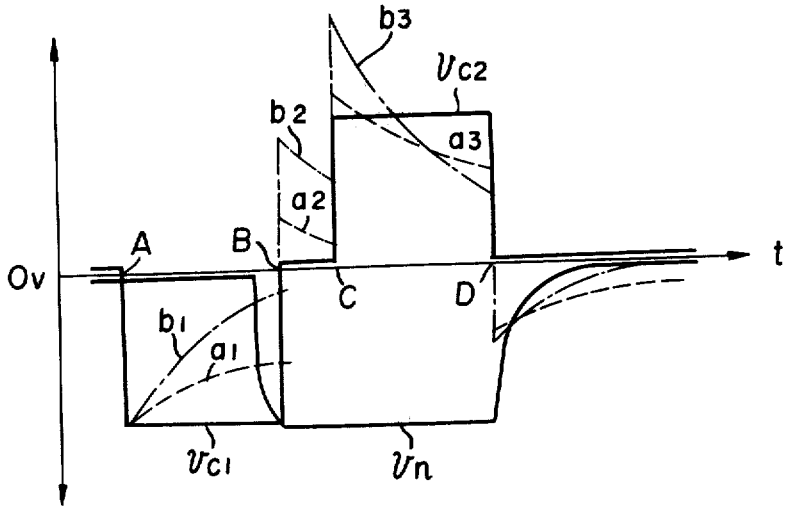
FIGS. 12 and 13 (*a*)-(*d*) respectively diagrams of waveforms of the other embodiment.
Figure 13A:
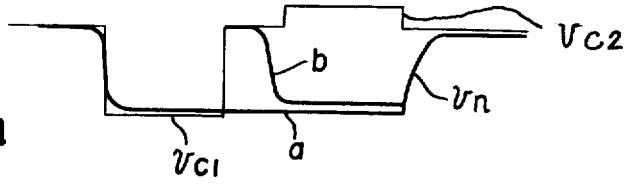
Figure 13B:
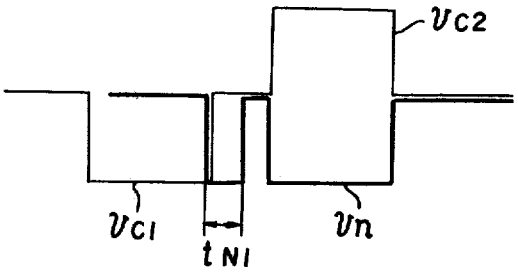
Figure 13C:
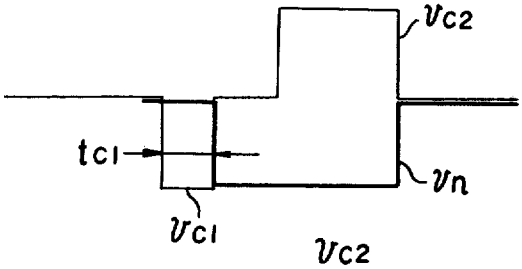
Figure 13D:
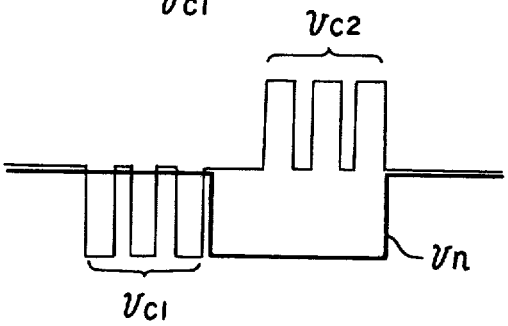

FIG. 12 is a diagram of characteristic of variation of $v_p$ when the period B to C is short. When the period B to C is short, the second control pulse voltage $v_{c2}$ is applied before the satisfactory attenuation of the turnover voltages by $v_{c1}$ (curves $a_2$, $b_2$) during the period B to C. Accordingly, the voltages are overlapped during the period C to D for applying the second control pulse voltage $v_{c2}$ and the peak value of $v_p$ is elevated over the second control pulse voltage $v_{c2}$ as shown by the curves $a_3$ and $b_3$. Thus, the peak value of $v_p$ in high humidity for sudden potential attenuation is higher than that of low humidity and accordingly, the decrease of the record density can be completely prevented and moreover, the record density in high humidity can be increased over that of the normal humidity.

In the embodiment shown in FIG. 12, the time applying the recording needle voltage $v_n$ is gained for the leading time of $v_n$, from the time B, so as to completely utilize the turnover voltage during the period B to C. Thus, the recordings are synergically performed by the curves $b_2$ and $b_3$ in high humidity whereby the complete compensation in high humidity can be attained.

FIGS. 13 (*a*)–(*d*) are diagrams for modifications of the electrographic imaging system of the present invention.

FIG. 13(*a*) shows the modification of the timing for applying $v_n$ wherein $v_n$ is applied at the same time applying $v_{c1}$ in the case a and $v_n$ is applied at the time gaining from the time applying $v_{c2}$. Thus, the timing for applying $v_n$ can be varied as far as earlier than the application of $v_{c2}$.

FIG. 13(*B* ) shows the modification of applying the divided recording needle voltage $v_n$. The record density can be controlled by controlling the pulse width $t_{n1}$. The recording stylus voltage is not limited to a single pulse.

FIG. 13(*c*) shows the modification that the pulse width $t_{c1}$ of $v_{c1}$ is shorter than that of $v_{c2}$. The turnover voltage of $v_{c1}$ can be controlled by $t_{c1}$ and accordingly, the humidity depending of the record density can be controlled.

In the system of the present invention, the pulse width, the pulse voltage or the waveform is not critical as far as the different polarity of the control pulse voltages $v_{c1}$ and $v_{c2}$.

FIG. 13(*d*) shows the modification wherein the control pulse voltages $v_{c1}$ and $v_{v2}$ are respectively divided into three to apply them. The control pulse voltage can be divided for each desired pulse numeral.

The combination of the modifications (a), (b), (c) or (d) is also possible.

Figure 14:
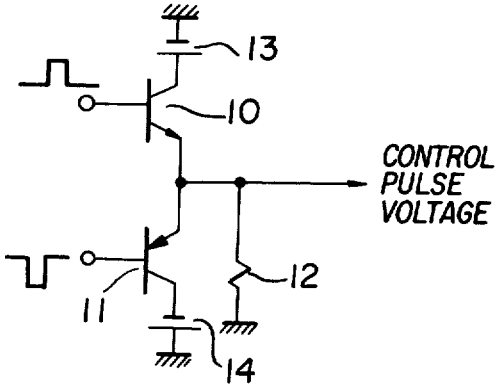
FIG. 14 is a circuit diagram of a control voltage applying circuit used in the system of the present invention.

FIG. 14 is a circuit diagram for generating the control pulse voltages having different polarities. The reference numerals (10), (11) respectively designate NPN and PNP transistors and (12) designates a load resistor; and (13), (14) respectively designate positive and negative power sources.

In the description of the present invention, the embodiment of a simple electrostatic record medium having a dielectric layer and a conductive medium in two layer structure has been illustrated. Thus, in the system of the present invention, a multi-layer electrostatic record medium having two or three layers for high speed recording can be used to provide the characteristics of the present invention. The structure of the electrostatic record medium is not critical.

The system of the present invention can be applied for any control system for controlling the potential of the conductive layer by a control electrode through the dielectric layer regardless of the structure, the arrangement and the grouping of the recording styluses and the grouping or the dividing of the control electrodes.

In the system of the present invention, the record medium is not limited to the electrostatic record paper, but it can be an electrostatic medium having a base of a plastic film; and an electrostatic medium formed on a cylindrical drum for a single surface control etc. Various electrostatic record media can be used for the controlling system of the present invention.

As described above, in accordance with the system of the present invention, it is possible to completely eliminate ghost image and the decrease of the record density even in high humidity. Thus, the system can be used for various fields such as fascimiles and electrographic printers and imparts excellent characteristics of the stability of the record and the improvement of quality of images.

We claim:

1. In an electrographic imaging system for driving a single surface control electrostatic recording head having recording stylus electrodes arranged in groups with respective stylus electrodes of each group connected in parallel and control electrodes arranged adjacent respective groups of stylus electrodes so as to form electrostatic latent images on a dielectric layer of a record medium contacting said recording head, an improvement characterized in that a first control pulse voltage is applied to selected control electrodes adjacent a selected respective group of stylus electrodes; and then a second control pulse voltage having a different polarity is applied to said selected control electrodes and simultaneously, a recording pulse voltage having the same polarity as the polarity of the first control pulse voltage is applied to said selected respective group of stylus electrodes.

2. An electrographic imaging system according to claim 1 wherein the potential difference of the first control pulse voltage to the earth is greater than the potential difference of the second pulse voltage to the earth.

3. An electrographic imaging system according to claim 1 wherein the period for applying the first control pulse voltage is longer than the period for applying the second control pulse voltage.

4. In an electrographic imaging system for driving a single surface control electrostatic recording head having recording stylus electrodes arranged in groups with respective stylus electrodes of each group connected in parallel and control electrodes arranged adjacent respective groups of stylus electrodes so as to form electrostatic latent images on a dielectric layer of a record medium contacting said recording head, an improvement characterized in that a first control pulse voltage is applied to selected control electrodes adjacent a selected respective group of stylus electrodes and then a second control pulse voltage having a different polarity is applied to said selected control electrodes and a recording pulse voltage having the same polarity as the polarity of the first control pulse voltage is applied to said selected respective group of stylus electrodes during a period from a time of the releasing of the first control pulse voltage to a time of the releasing of the second control pulse voltage.

5. An electrographic imaging system according to claim 4 wherein the first and second control pulse voltages are respectively formed by voltages having plural pulse forms.

6. An electrographic imaging system according to claim 4 wherein the recording pulse voltage is formed by voltages having plural pulse forms.

* * * * *